US009694951B2

(12) United States Patent
Friedland

(10) Patent No.: US 9,694,951 B2
(45) Date of Patent: Jul. 4, 2017

(54) RECLOSABLE ELASTOMERIC FASTENER

(71) Applicant: Kittrich Corporation, Pomona, CA (US)

(72) Inventor: Robert J. Friedland, Pomona, CA (US)

(73) Assignee: KITTRICH CORPORATION, Pomona, CA (US)

( * ) Notice: Subject to any disclaimer, the term of this patent is extended or adjusted under 35 U.S.C. 154(b) by 173 days.

(21) Appl. No.: 14/323,645

(22) Filed: Jul. 3, 2014

(65) Prior Publication Data

US 2015/0008224 A1 Jan. 8, 2015

Related U.S. Application Data

(60) Provisional application No. 61/842,622, filed on Jul. 3, 2013.

(51) Int. Cl.

| | |
|---|---|
| ***B65D 45/18*** | (2006.01) |
| ***B65D 45/22*** | (2006.01) |
| ***B65D 45/04*** | (2006.01) |
| ***B65D 45/02*** | (2006.01) |
| ***B65D 53/02*** | (2006.01) |
| *B65D 43/02* | (2006.01) |

(52) U.S. Cl.

CPC ..... *B65D 45/22* (2013.01); *B65D 45/02* (2013.01); *B65D 45/04* (2013.01); *B65D 53/02* (2013.01)

(58) Field of Classification Search

CPC ..... B65B 7/2842; A45C 13/1092; A45C 13/1084; B65D 45/04; B65D 45/22; B65D 45/16; B65D 45/18; B65D 45/02; B65D 53/02

USPC ..... 220/326, 315, 319, 324, 780, 642, 640

See application file for complete search history.

(56) References Cited

U.S. PATENT DOCUMENTS

| | | | | | |
|---|---|---|---|---|---|
| 2,045,374 | A * | 6/1936 | Shields | A45D 40/221 | 206/557 |
| 2,237,102 | A * | 4/1941 | Hungerford | A21B 3/15 | 220/641 |
| 3,073,479 | A * | 1/1963 | Broverman | B65D 45/18 | 220/326 |
| 3,088,623 | A * | 5/1963 | Parker | A45C 13/10 | 190/28 |
| 3,741,843 | A * | 6/1973 | Louis | A47B 96/202 | 156/244.22 |
| 4,210,259 | A * | 7/1980 | Schrecker | B65D 7/38 | 220/62.22 |
| 5,069,354 | A * | 12/1991 | Tannenbaum | B65D 11/188 | 190/122 |
| 5,487,690 | A * | 1/1996 | Stoffle | A63H 33/10 | 16/225 |
| 5,634,539 | A * | 6/1997 | Gordon | A45C 5/02 | 190/24 |

(Continued)

*Primary Examiner* — J. Gregory Pickett
*Assistant Examiner* — Niki M Eloshway
(74) *Attorney, Agent, or Firm* — Nevrivy Patent Law Group P.L.L.C.

(57) ABSTRACT

A reclosable elastomeric fastener and method for sealing storage and serving containers using same. The fastener consists of two complementary elastomeric profiles, having male and female interlocking elements, which extend around the periphery of the lid and container components of a storage receptacle. The reclosable fastener forms a water-resistant seal when the male and female elements of the complementary profiles are mutually occluded.

15 Claims, 3 Drawing Sheets

(56) References Cited

U.S. PATENT DOCUMENTS

| | | | | |
|---|---|---|---|---|
| 5,782,371 | A * | 7/1998 | Baerenwald | B65D 43/168 16/DIG. 13 |
| 5,855,766 | A * | 1/1999 | Mamiye | A45C 3/00 150/120 |
| 6,010,005 | A * | 1/2000 | Reames | A47G 23/06 206/557 |
| 6,131,248 | A | 10/2000 | Tomic | |
| 6,415,947 | B1 | 7/2002 | Kim | |
| 6,539,594 | B1 | 4/2003 | Kasai et al. | |
| 6,719,166 | B2 * | 4/2004 | Ceolin | B65D 43/0206 220/780 |
| 6,772,905 | B2 * | 8/2004 | Cheng | B65D 43/166 16/355 |
| 7,047,576 | B2 * | 5/2006 | Tavivian | A47K 3/30 16/225 |
| 7,234,865 | B2 | 6/2007 | Piechocki | |
| 7,318,257 | B2 | 1/2008 | Offa-Jones | |
| 7,611,284 | B2 | 11/2009 | Borchardt et al. | |
| 8,485,390 | B2 * | 7/2013 | Cronin | B65D 43/166 220/4.22 |
| 2005/0274724 | A1 * | 12/2005 | Goggin | B65D 41/3442 220/257.1 |

* cited by examiner

RECLOSABLE ELASTOMERIC FASTENER

RELATED APPLICATION DATA

The present application is a non-provisional application claiming the benefit of priority from U.S. Provisional Application No. 61/842,622 filed Jul. 3, 2013, the entirety of which is hereby incorporated by reference.

BACKGROUND OF THE INVENTION

1. Field of the Invention

The present invention is directed toward reclosable fasteners and a method for sealing storage and serving containers. In particular, the invention features a complementary elastomeric fastener, composed of male and female elements, which extend around the periphery of the lid and container components of a storage receptacle. Two molded elastomeric fasteners of equivalent size are configured in a corresponding tongue and groove arrangement, so that the tongue of one fits into the groove of the other, thereby joining the two fasteners together forming an interlocking seal. The fasteners are available in various shapes to accommodate square, rectangular and round storage containers.

2. Description of the Prior Art

Aluminum storage and serving containers are commonly offered within the kitchenware departments of retail venues, and typically consist of die stamped foil pans having corresponding lid components. In general, the constituent pan or lid assembly is fashioned with a projecting flange portion that is disposed to facilitate the sealing of food contents within the receptacle. The extending flange is designed to manually fold and crimp around the periphery of the container so that the pan may be stored and later transported.

The primary disadvantage, inherent within prior art aluminum foil storage and serving containers, concerns the inadequacy of the peripheral flange to efficiently close and open with repetitive use. The utilization of a hand closeable flange not only creates an uneven seal upon initial application of the lid, but in order to access the contents of the pan, the consumer must first pry open the rim, thereby exposing sharp metallic edges that are prone to cause injury. Additionally, the incapacity of the flange to form an impervious seal inhibits the functionality of the container to avoid accidental spills. Until now, the more convenient means for storing and retaining various food items was limited to molded containers having reclosable fasteners or, alternatively, resealable plastic bags featuring interlocking ridges. For example, U.S. Pat. No. 6,415,947, issued on Jul. 9, 2002 to C. Kim, discloses an airtight container for food comprising a four-sided plastic receptacle having a detachable lid. The lid features a configuration of interlocking wings that are hinged along the periphery of the cover, each having an arrangement of apertures that correspond to a plurality of locking projections disposed along the top portion of the receptacle. The lid further includes a subjacent recess adapted to retain a deformable seal that engages the rim of the plastic receptacle upon securing the container.

The use of interlocking fastening devices for the closure of containers, including plastic bags, is also known in the art. For instance, U.S. Pat. No. 6,131,248, issued on Oct. 17, 2000 to M. Tomic, describes a multipart closure arrangement for use with a flexible or rigid polymeric package. The profile of the resealable structure includes the use of a closure member composed of corresponding male and female interlocking ribbed and grooved components. The closure mechanism also features the use of peelable and sealant layers produced from an assorted selection of coextruded molten polymeric resins. The closure profile additionally consists of complementary first and second base strips adapted for attachment to a polymeric package.

U.S. Pat. No. 6,539,594, issued on Apr. 1, 2003 to J. Kasai et al., discloses a plastic zipper having enhanced durability permitting cyclical opening and closing operations. The interlocking profiles of the male and female components enable the hermetic resealing of the extruded closure through the course of repeated use. The fastener may be utilized for simplified containers including packaging for foods, pharmaceuticals and the like.

U.S. Pat. No. 7,234,865, issued on Jun. 26, 2007 to D. Piechocki, describes a zipper closure for plastic bags having a collapsible element extruded within the reclosable male or female components of an interlocking profile. The collapsible element enhances the hermetic sealing of the thermoplastic fastener upon mutual engagement of the complementary male and female profiles by way of creating an axial force between the interconnected components.

U.S. Pat. No. 7,318,257, issued on Jan. 15, 2008 to M. Offa-Jones, discloses a reclosable fastener for plastic bags and other containers. The structure of the closure device resists damage or thermal deformation to the fastener when applied to plastic film using cross-web techniques. The reclosable fastener comprises two mutually engaging elements having an identical arrangement of protruding hooks that project from complementary body portions. An extended flange is provided on one body portion for use as a facing attachment to the inside of a plastic bag.

U.S. Pat. No. 7,611,284, issued on Nov. 3, 2009, to M. Borchardt et al., describes a closure device for plastic bags having first and second fastening strips separated by an intermediate area. The interlocking elements are respectively formed from opposing opaque and translucent components having complementary colors. The occlusion of the two closure elements produces a color-changing effect, thereby exhibiting visual confirmation that a seal has been properly formed to effectively retain the contents within a plastic storage container.

The systems, methods, and inventions described in the above-identified patent publications are found lacking in disclosing an improved reclosable elastomeric fastener for sealing storage and serving containers.

Accordingly, it is a principal object of the present invention to provide a reclosable elastomeric fastener for sealing storage and serving containers.

It is a further object of the present invention to provide a reclosable elastomeric fastener that adjustably conforms around the periphery of the lid and container components of a storage receptacle.

It is yet another object of the present invention to provide a reclosable elastomeric fastener featuring complementary male and female components that form an interlocking seal when occluded.

It is an alternate object of the present invention to provide a fastener wherein a single elastomeric profile mutually engages the lid and container components of a storage receptacle.

It is yet a further alternate object of the present invention to provide an elastomeric fastener that includes a thermochromic pigment to provide a visible indication as to the surface temperature of a storage receptacle.

Finally, an object of the present invention is to provide an elastomeric fastener that prevents injury from sharp metallic edges.

SUMMARY OF THE INVENTION

The limitations of the background art discussed above are overcome by the present invention. With this invention, an improved reclosable elastomeric fastener extends around the periphery of a storage receptacle to form a water resistant seal for storage and transport. In a preferred embodiment, the reclosable fastener comprises two identical interlocking profiles having corresponding male and female elements. The interlocking profiles are designed to independently conform to the circumferential rim of the lid and container components, which subsequently produce a water-resistant seal when mutually occluded. Alternatively, the fastener may consist of a single elastomeric profile, in which a lateral groove mutually joins the lid and container components to form an impervious seal. The elastomeric fastener of either embodiment may also include the use of a thermochromic pigment to provide a visible indication as to the surface temperature of the storage container.

In accordance with the present invention, the reclosable fasteners are formed from an elastomeric polymer that facilitates the adjustable expansion and contraction of the sealable profiles to fit the components of a storage receptacle. In a preferred embodiment, the elastomeric polymer may be selected from the group of Chlorosulfonated Polyethylene (CSPE), Ethylene Polypropylene Rubber (EPM), Ethylene Propylene Diene Monomer (EPDM), Isobutylene Isoprene Rubber (IIR), Siloxane compounds, or other appropriate polymeric formulations. The reclosable fastener may be produced by way of casting, extruding, or injection molding the polymer to form the elastomeric profile.

The present invention features a reclosable fastener having interlocking profiles that are formed from at least two polymeric resins having differing viscoelastic properties. In a preferred embodiment, a circumferential flange includes male and female elements having dissimilar shore durometers to ensure optimal occlusion of the interlocking profile. Moreover, the lateral groove of each profile includes serrations for the frictional attachment of the reclosable fastener to the peripheral rim of the lid and container components of a storage receptacle. The reclosable fastener may, alternatively, be formed from a single polymeric resin having a uniform shore durometer, or may further consist of a single profile that is utilized to create an impervious seal.

Further objects and advantages of the present invention will be apparent from the following description of the preferred embodiments when considered in conjunction with accompanying drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
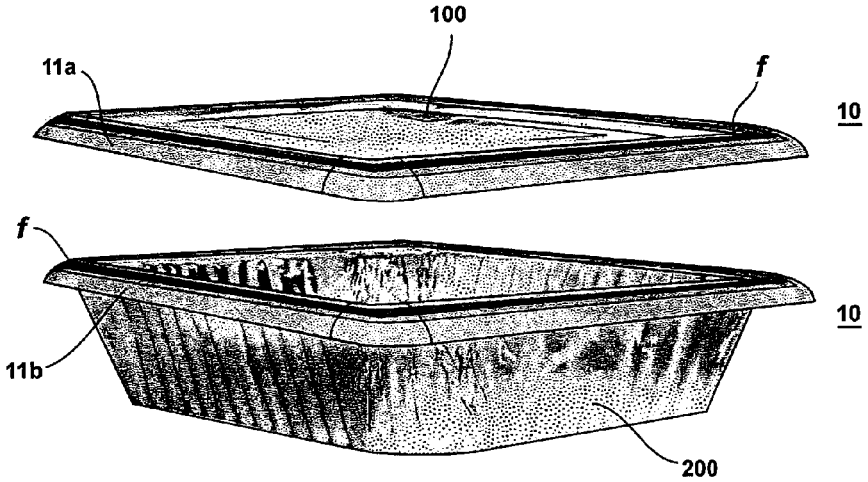
FIG. 1 is a perspective exploded view of a reclosable elastomeric fastener according to the present invention.
Figure 2:
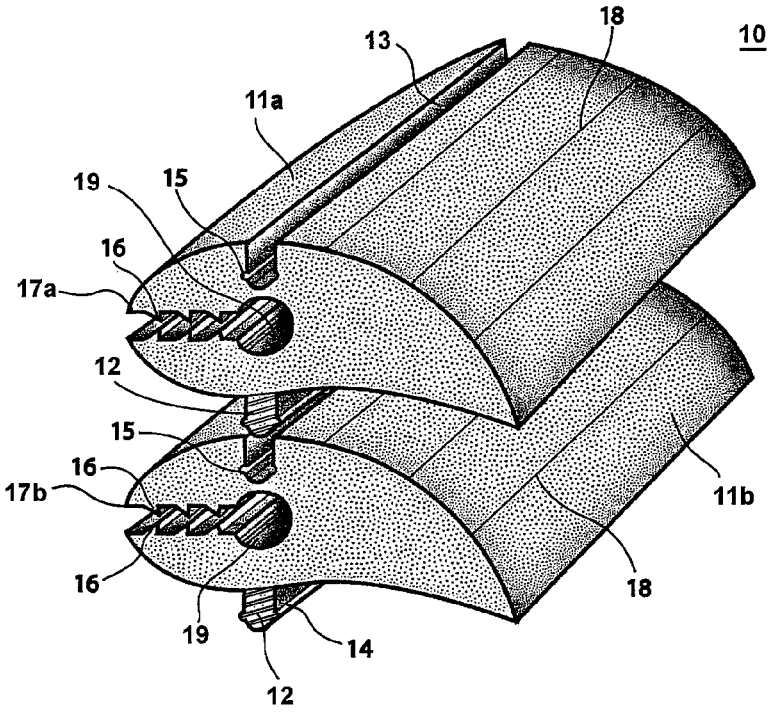
FIG. 2 is a perspective cut away view showing a reclosable elastomeric fastener according to a preferred embodiment of the present invention.
Figure 3:
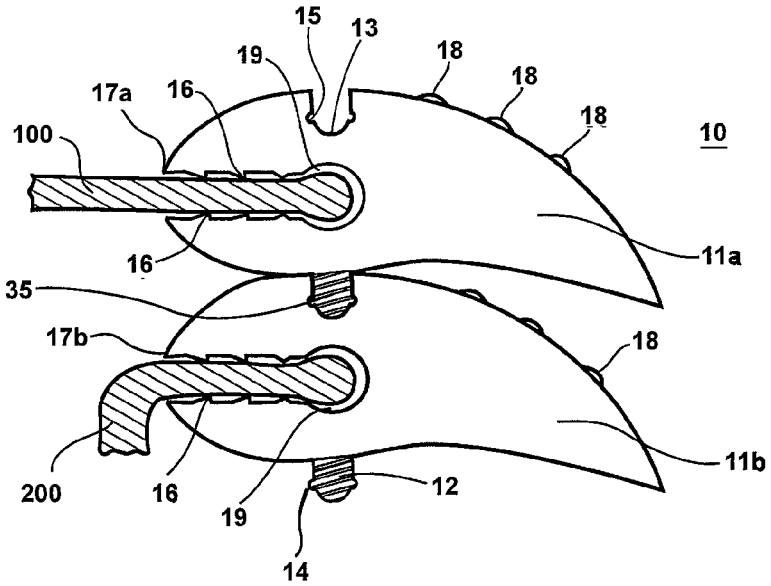
FIG. 3 is a cross-sectional view showing the occluded profiles according to a preferred embodiment of the present invention.

The present invention is a reclosable elastomeric fastener and method for sealing storage and serving containers. In a preferred embodiment, and as shown in FIGS. 1-3, the reclosable fastener 10 comprises two interlocking teardrop shaped profiles, 11*a* and 11*b*, having corresponding male and female elements 12 and 13, respectively. The male element 12 includes two horizontally oriented ribbed protrusions 14, which coincide with two interlocking lateral notches 15 inscribed within female element 13. The interlocking profiles are also designed to independently conform to the circumferential rim of lid 100, and to the periphery of container 200, the projections of which dovetail into lateral grooves 17*a* and 17*b* of interlocking profiles 11*a* and 11*b*. The lateral grooves terminate at a circular furrow 19, and include an arrangement of extending reciprocal serrations 16, which engage the rim and periphery of the lid 100 and container 200 components, respectively. The teardrop shaped profiles additionally feature an extended flange, having an arrangement of elevated knurl lines 18, to provide an increased surface area for grasping the reclosable fastener. The interlocking profiles 11*a* and 11*b* form a water resistant seal 35 when the corresponding male and female elements, 12 and 13, are mutually occluded.

The reclosable fasteners, 11*a* and 11*b*, are formed from an elastomeric polymer that facilitates the adjustable expansion and contraction of the sealable profiles to fit the components of a storage receptacle. In a preferred embodiment, the elastomeric polymer may be selected from the group of Chlorosulfonated Polyethylene (CSPE), Ethylene Polypropylene Rubber (EPM), Ethylene Propylene Diene Monomer (EPDM), Isobutylene Isoprene Rubber (IIR), Siloxane compounds, or other appropriate polymeric formulations. The reclosable fastener may be produced by way of casting, extruding, or injection molding the polymer to form the elastomeric profile.

As shown in FIGS. 1-4, the interlocking profiles 11*a* and 11*b* are co-injection molded or coextruded from at least two polymeric resins having different viscoelastic properties. In a preferred embodiment, the circumferential flanges f are comprised of male and female elements, 12 and 13, which have dissimilar shore durometers to enhance the optimal occlusion of the interlocking profiles. The interlocking profiles 11*a* and 11*b* may also consist of a uniform contour of elastomeric resin (not shown) that may be joined to circumferential flanges having equivalent or dissimilar shore durometers without departing from the scope of the invention.

Figure 5:
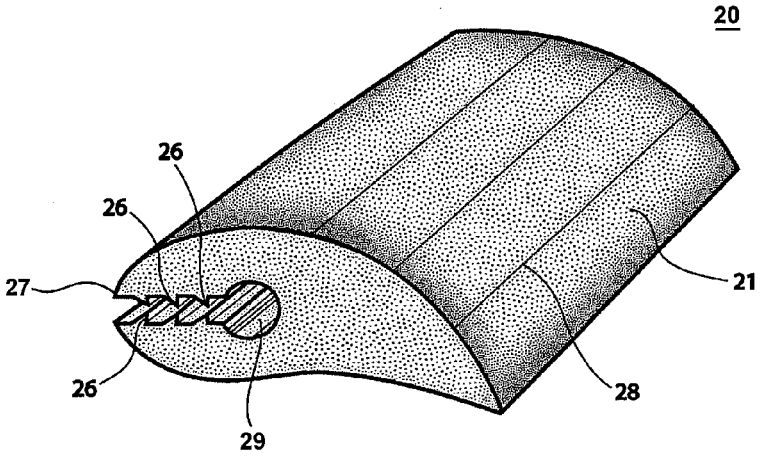
FIG. 5 is a perspective cut away view showing an elastomeric fastener according to a first alternate embodiment of the present invention.
Figure 6:
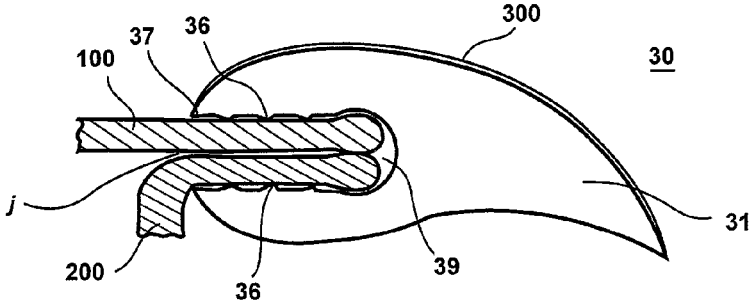
FIG. 6 is a cross-sectional view showing an elastomeric fastener according to a second alternate embodiment of the present invention.

In an alternate embodiment, and as illustrated in FIGS. 5 and 6, an elastomeric fastener 20 or 30 may comprise a single profile 21 or 31, having a lateral groove 27 or 37, designed to mutually engage the lid and container components 100 and 101 of a storage receptacle. The lateral groove 27 or 37 terminates at a circular furrow 29 or 39, and includes a series of reciprocal serrations 26 or 36, which simultaneously grip the rim of lid 100, and periphery of container 200, to form an impervious seal. The profile 21 or 31 additionally features an extended flange, which may have an arrangement of elevated knurl lines 28 to provide an increased surface area for grasping the fastener. The elastomeric fastener 20 or 30 may be injection molded or extruded from a homogeneous elastomeric polymer that conforms to the circumferential periphery of an enclosed storage receptacle. The elastomeric polymer may be selected from the same group of polymers used to form the reclosable interlocking profiles of the present invention. In a further embodiment, and as shown in FIG. 6, the profile 31 of the elastomeric fastener 30 may also include a resinous coating 300 containing a thermochromic pigment to provide a visible indication as to the surface temperature of the storage receptacle.

To attain a water-resistant seal, the reclosable fastener 10, 20, or 30 may be cast or injection molded from an elastomeric polymer to form a continuous ring (not shown). The circumferential profiles may be molded to accommodate square, rectangular and round storage receptacles. Alternatively, the elastomeric profiles may be extruded to form a discontinuous strip that may be applied around the rim and periphery of the lid 100 and container 200 components, respectively. It can be further appreciated that the elastomeric profiles are not limited with respect to shape, and that the interlocking fasteners may consist of equivalent or dissimilar geometric profiles to conform to the contour of the peripheral rim of a storage and serving container.

According to the present invention, the method of sealing the lid and container components of a storage receptacle is simplified by way of first attaching the elastomeric profiles 11*a* and 11*b* of the reclosable fastener 10 to the circumferential rim of lid 100, and to the periphery of container 200. The method includes the initial step of inserting a portion of rim 100 into a segment of lateral groove 17*a* formed within elastomeric profile 11*a*, and then stretching the profile 11*a* to conform to the circumference of lid 100, while simultaneously inserting rim into the lateral groove 17*a*. In the same way, the extending periphery of container 200, is then initially inserted into the lateral groove 17*b* of elastomeric profile 11*b*, with the orientation of the elastomeric profile 11*b* corresponding to fit either the male or female elements, 12 or 13, of elastomeric profile 11*a*. The profile 11*b* is then stretched to conform to the perimeter of container 200, while simultaneously inserting peripheral edge 200 into lateral groove 17*b*. To ensure the optimal conformity between the lid 100 and container 200 components, the leading edges of rim and periphery should fully dovetail into the circular furrows 19 of elastomeric profiles 11*a* and 11*b*. After the elastomeric profiles 11*a* and 11*b* have been fully attached and adjusted to conform to the lid and container of a storage receptacle, the corresponding male and female elements 12 and 13, having interlocking components 14 and 15, may be mutually compressed to form a reclosable water-resistant seal 35.

Figure 4:
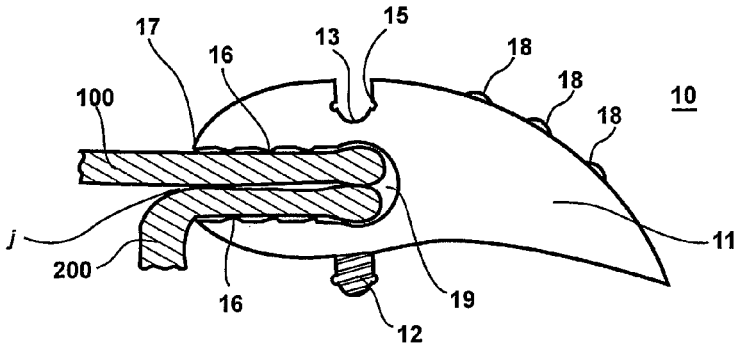
FIG. 4 is a cross-sectional view showing the alternate use of a reclosable elastomeric fastener according to a preferred embodiment of the present invention.

In a further embodiment, and as shown in FIGS. 4-6, the method of sealing the lid and container of a storage receptacle may also be facilitated through the use of a single elastomeric profile 10, 20, or 30. This alternate method includes the initial step of positioning the lid and container components 100 and 200 in a corresponding enclosed relation, and then securing an elastomeric profile 11, 21, or 31, around the adjoining lid 100 and container 200 of the receptacle. As similarly exemplified in the foregoing method, an elastomeric profile envelopes the juncture j of the enclosed lid and container components, wherein a portion of the adjoining lid 100 and container 200 are first inserted into a segment of lateral groove 17, 27, or 37, formed within the elastomeric profile 11, 21 or 31. The elastomeric fastener 10, 20, or 30, is then stretched to conform to the circumference of the assembled lid 100 and container 200 components, while the remainder of the unsecured portions of the rim and periphery are simultaneously inserted to dovetail into the lateral groove 17, 27 or 37 of the elastomeric profile. The elastomeric profile 10, 20, or 30 is then adjusted to fully conform to the enclosed lid and container components 100 and 200 to form an impervious seal.

Even though numerous characteristics and advantages of the present invention have been set forth in the foregoing description, together with details of the structure and function of the preferred embodiments, the above disclosure is illustrative only. Changes may be made in detail, especially in matters of shape, size and arrangement of parts within the principles of the invention to the full extent indicated by the broad general meaning of the terms in which the appended claims are expressed.

What is claimed is:

1. A reclosable elastomeric fastener for sealing storage and serving containers comprising:

(a) at least two interlocking shaped profiles, each having a serrated lateral groove along with corresponding male and female elements;

(b) wherein each interlocking profile engages and independently conforms to a circumferential rim of a lid, or to the peripheral edge of a container;

(c) wherein each interlocking profile is formed from at least two elastomeric polymers having dissimilar shore durometers and the male element of the interlocking profile has a dissimilar shore durometer in comparison to the female element and (d) whereby the male and female elements form a water-resistant seal when mutually occluded.

2. The reclosable elastomeric fastener of claim 1, wherein each interlocking profile is formed from an elastomeric polymer selected from the group consisting of Chlorosulfonated Polyethylene, Ethylene Polypropylene Rubber, Ethylene Propylene Diene Monomer, Isobutylene Isoprene Rubber, and Siloxane compounds.

3. The reclosable elastomeric fastener of claim 1, wherein the interlocking profile further includes a male element having two horizontally oriented ribbed protrusions that coincide with two lateral notches inscribed within the female element.

4. The reclosable elastomeric fastener of claim 1, wherein each interlocking profile has an extending flange having an arrangement of knurl lines for grasping the reclosable fastener.

5. The reclosable elastomeric fastener of claim 1, wherein each interlocking profile is molded from an elastomeric polymer to form a continuous ring.

6. The reclosable elastomeric fastener of claim 1, wherein each interlocking profile is extruded to form a discontinuous strip.

7. A reclosable elastomeric fastener for sealing storage and serving containers comprising:

(a) at least two interlocking shaped profiles, each having a serrated lateral groove along with corresponding male and female elements;

(b) wherein each interlocking profile engages and independently conforms to a circumferential rim of a lid, or to the peripheral edge of a container;

(c) wherein each interlocking profile is formed from one elastomeric polymer, (d) wherein each interlocking profile has dissimilar shore durometers in comparison with one another, and (e) whereby the male and female elements form a water-resistant seal when mutually occluded.

8. The reclosable elastomeric fastener of claim 7, wherein each interlocking profile has similar shore durometers in comparison with one another.

9. An elastomeric fastener for sealing storage and serving containers comprising:

(a) a single profile having a serrated lateral groove;

(b) wherein the single profile is formed from two elastomeric polymers and adjustably conforms to a circumferential rim of a lid and the peripheral edge of a container; and (c) whereby the serrated groove simultaneously grips the lid and container components of a storage receptacle to form an impervious seal.

10. The elastomeric fastener of claim 9, wherein the profile is formed from an elastomeric polymer selected from the group consisting of Chlorosulfonated Polyethylene, Ethylene Polypropylene Rubber, Ethylene Propylene Diene Monomer, Isobutylene Isoprene Rubber, and Siloxane compounds.

11. The elastomeric fastener of claim 9, wherein the profile is formed from one elastomeric polymer.

12. The elastomeric fastener of claim 9, wherein the profile has an extending flange having an arrangement of knurl lines for grasping the reclosable fastener.

13. The elastomeric fastener of claim 9, wherein the profile includes a resinous coating containing a thermochromic pigment.

14. The elastomeric fastener of claim 9, wherein the profile is molded from an elastomeric polymer to form a continuous ring.

15. The elastomeric fastener of claim 9, wherein the profile is extruded to form a discontinuous strip.

* * * * *